United States Patent [19]

Bialorucki et al.

[11] 4,099,486

[45] Jul. 11, 1978

[54] ELECTROSTATICALLY COATING HOLLOW GLASS ARTICLES

[75] Inventors: Edward J. Bialorucki, Shippenville, Pa.; Ronald W. Bradley, Toledo; David G. Carl, Sylvania, both of Ohio

[73] Assignee: Owens-Illinois, Inc., Toledo, Ohio

[21] Appl. No.: 781,603

[22] Filed: Mar. 28, 1977

[51] Int. Cl.[2] ..... B05B 5/02

[52] U.S. Cl. ..... 118/635; 118/322; 118/500; 118/630; 427/29; 427/425

[58] Field of Search ..... 118/624, 627, 629, 630, 118/631, 632, 633, 634, 635, 500, 502, 503, 320, 322, DIG. 3; 427/29, 30, 425

[56] References Cited

U.S. PATENT DOCUMENTS

| | | | |
|---|---|---|---|
| 2,210,187 | 8/1940 | Ross | 118/500 |
| 2,463,422 | 3/1949 | Ransburg et al. | 118/635 |
| 2,553,724 | 5/1951 | Ransburg | 118/635 |
| 2,600,161 | 6/1952 | Fouse | 118/500 |
| 2,655,128 | 10/1953 | Ransburg | 118/635 |
| 2,662,833 | 12/1953 | Helmuth | 118/320 X |
| 3,740,259 | 6/1973 | Carl et al. | 118/320 X |
| 3,741,793 | 6/1973 | Simmons | 118/630 X |
| 3,777,875 | 12/1973 | Sobran | 198/680 |
| 3,855,966 | 12/1974 | Panas | 118/503 X |
| 3,951,101 | 4/1976 | Karakawa et al. | 118/322 X |
| 4,009,301 | 2/1977 | Heckman | 118/503 X |

*Primary Examiner*—Mervin Stein

*Attorney, Agent, or Firm*—D. T. Innis; Myron E. Click; David H. Wilson

[57] ABSTRACT

Bottle supporting and masking apparatus wherein the container or article to be coated electrostatically is carried in an inverted up-right position through an electrostatically charged particle spray zone, with the container supported by a non-conductive neck or finish masking chuck. The container is heated to render its surface conductive and four embodiments of supports are disclosed, each of which will provide a grounding of the container.

10 Claims, 6 Drawing Figures

ELECTROSTATICALLY COATING HOLLOW GLASS ARTICLES

BACKGROUND OF THE INVENTION

In the handling of containers, particularly open-mouth glass containers, it is common practice to support the bottles from outside during processing steps. In particular, when supporting containers by their necks for transport through an electrostatic particle spray zone, it is desirable to prevent build-up of spray while coating material on the finish of the container. An example of a support means for suspending containers for carrying the bottles through a coating zone is shown in U.S. Pat. No. 3,777,875. In this particular patent, the bottle is supported by an internal gripping tool which enters the neck of the bottle with the tool being of a non-conductive, springlike material. A sleeve of non-conductive material rides on the upper finish of the surface of the container mouth and is utilized to strip the supportive container from the chuck upon completion of the coating or other processing that is carried out during the transport of the containers from one location to another.

Reference may be made to U.S. Pat. No. 4,009,301 wherein build-up on bottle handling chucks for containers being conveyed through a spray coating process is minimized by the specific transfer of the containers from a heated chuck to a relative cool chuck.

An example of a container being supported in inverted position while being transported through a spray coating process is shown in U.S. Pat. No. 3,740,259. This particular patent shows a threaded mask to which a container having a threaded neck may be applied, with the mask having an O ring at the upper end thereof to prevent excess spray from flowing into the threaded neck of the container. It is assumed that in order to get complete coverage of the container, an excess of coating material will necessarily need to be applied.

SUMMARY OF THE INVENTION

The invention is a chuck for supporting glass containers through an electrostatic spray coating process in which the chuck is of a specific configuration to prevent build-up of coating thereon, coupled with a system for grounding the container, which is at a temperature sufficient to make its surface relatively conductive to attract the charged spray particles. The grounding of the container is through a system that will specifically help in achieving a uniform coating on the exterior surface of the container while keeping the coating from the finish and avoiding excess coating on the handling equipment.

DETAILED DESCRIPTION OF THE DRAWINGS

In the electrostatic coating of glass containers or other glass articles, it is well known that glass is a dielectric at room temperature and has a relatively low surface conductivity. Generally, these containers would have little, if any, attraction for particles, charged in a normal electrostatic spray process. It has been found, however, that when containers are heated in the range of 150° F. to 450° F., their surface resistivity is reduced and the surface becomes fairly conductive. The present process and the equipment for carrying out the process requires the containers to be at an elevated temperature so that their surface will be conductive and the system for moving the containers through an electrostatic spray zone should effectively ground the surface of the glass article.

Figure 1:
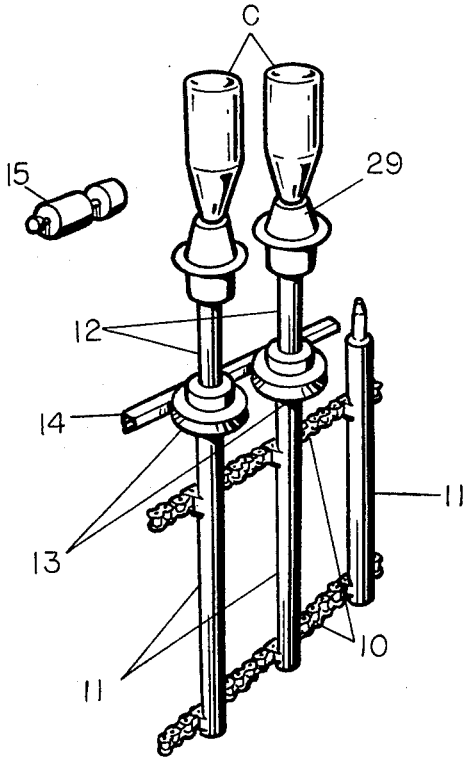
FIG. 1 is a perspective view of two spindles and chucks of the invention with containers carried thereby.

With specific reference to FIG. 1, there is shown schematically a pair of chains 10 to which are connected support spindles 11. It should be understood that the chains 10 are endless and only a portion of the straight running section thereof are shown in FIG. 1. The chains will transport a plurality of spindles 11 in a generally horizontal direction through a path which would describe generally an ellipse with straight sides. The spindles 11 have generally rotatable upper portions 12 to which are fixed pulleys 13. The pulleys 13, during the movement of the spindles through the elliptical path, will bear against a belt 14 which may be either stationary or moving in a direction opposite to that of the direction of movement of the chains 10 to cause rotation of the portions 12 of the spindles 11.

An electrostatic spray head 15 is positioned to direct a particulate spray toward the side of containers C which are supported on the upper ends of the spindles 11. The spindles are, in actual practice, also moved through a heating zone to heat the containers to a temperature between 150° F. and 450° F. so as to make the glass surface relatively conductive prior to the entry into the electrostatic spray zone.

Figure 2:
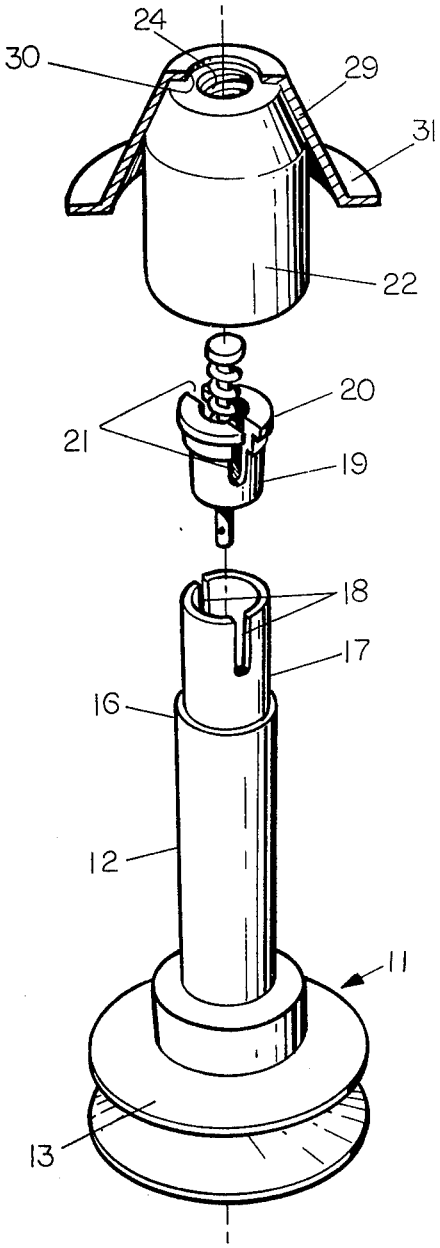
FIG. 2 is an enlarged, exploded view of one of the spindles and chuck of FIG. 1.

With particular reference to FIG. 2, the detailed configuration of one example of the preferred embodiment of the chuck or spindle of the invention is shown in exploded view.

Figure 3:
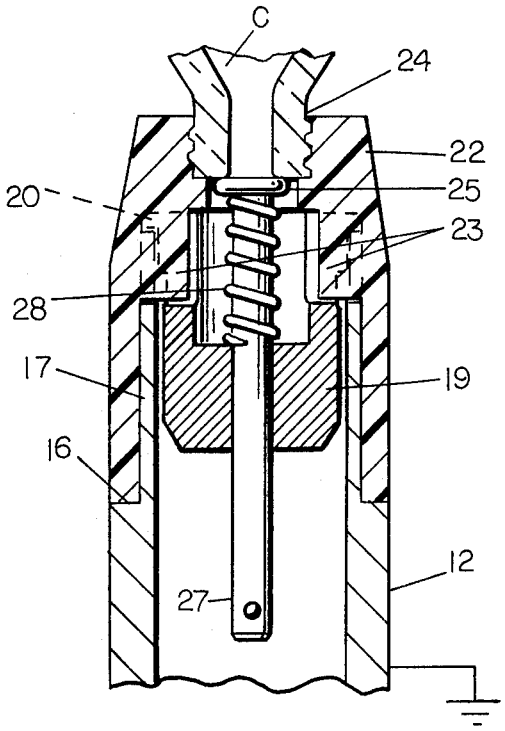
FIG. 3 is a vertical, cross-sectional view of the spindle of FIG. 2 in assembled form supporting a container by its neck.

Reference to FIG. 3 may also be had, inasmuch as the spindle of FIG. 2 is shown in cross-sectional detail on an enlarged scale in FIG. 3.

As can readily be seen, the upper portion of the spindle 11 is in the form of a hollow cylinder 12 which is necked down at 16 to form a cylinder 17 of slightly less OD than the lower portion 12. A pair of diametrically spaced, vertical slots 18 are formed through the wall of the cylinder 17. A spindle ground plug 19 with an upper ledge 20 and having an outside diameter slightly less than the inside diameter of the cylinder 17 is adapted to be telescopically mounted in the cylinder 17. A pair of vertical slots 21, similar to the slots 18 formed in the cylinder 17 are provided extending downwardly from the top in the ground plug 19. The ground plug 19 is adapted to be seated within the upper end of the cylinder 17 with the ledge 20 overlying the upper edge of the cylinder 17. The slots 21 are placed in alignment with the slots 18.

As best shown in FIG. 3, a non-conductive plastic chuck 22 is adapted to telescope over the ground plug 19 and the reduced diameter cylinder 17 of the spindle 11. The chuck 22 has a vertical bore extending therethrough which, as previously stated, telescopes over the cylinder 17. The chuck also is provided with two inwardly extending ears 23. The ears 23 will extend within the slots 21 and 18 when the chuck 22 is assembled on the spindle 11 and maintain the elements in alignment.

As best shown in FIG. 3, the upper end of the chuck 22 is internally threaded at 24 and is further provided with an axial opening 25, of reduced diameter, in alignment with the axis of the chuck. The opening 25 is of sufficient size to receive a head 26 of a ground pin 27. A helical compression spring 28 surrounds the ground pin and biases the ground pin 27 in a vertical direction. Inasmuch as the spring is positioned between the ground plug 19 and the head 26 of the ground pin 27, when a container C is threaded into the chuck 22, the head 26 will be held in contact with the neck of the container. In this manner a ground path is completed from the container through the ground pin and to the ground plug which in turn is in contact with the upper cylinder portion 17 of the conductive spindle 11.

As can readily be seen, when the spindle of FIG. 2, assembled as shown in FIG. 3, is used to carry containers through an electrostatic spray coating system, the containers will have their necks shielded by the non-conductive chuck 22 from attracting charged spray particles thereto. However, the ground pin 27 being in contact with the container C, which, as previously explained is at an elevated temperature such that its surface is conductive, will attract charged particles thereto and provide an even coating on the containers. Furthermore, the chuck, having a relatively long skirt portion which seats at 16 on the portion 12 and spindle 11, will shield the ground plug and the metal or conductive portion 12 of the spindle will not be coated to any significant degree by the electrostatically charged particles.

As an additional protector for the chuck, an aluminum cone 29, shown specifically in FIG. 2, is carried by the chuck 22. It should be noted that opening 30 in the protector or cone 29 is substantially larger than the threaded opening 24 in the chuck. In this manner the cone 29 will not be grounded and it will not specifically attract charged coating material. However, any spray which might migrate toward the chuck 22, will be caught by the cone 29 or by an annular, flared skirt 31 formed on the lower end of the protector or cone 29.

Figure 4:
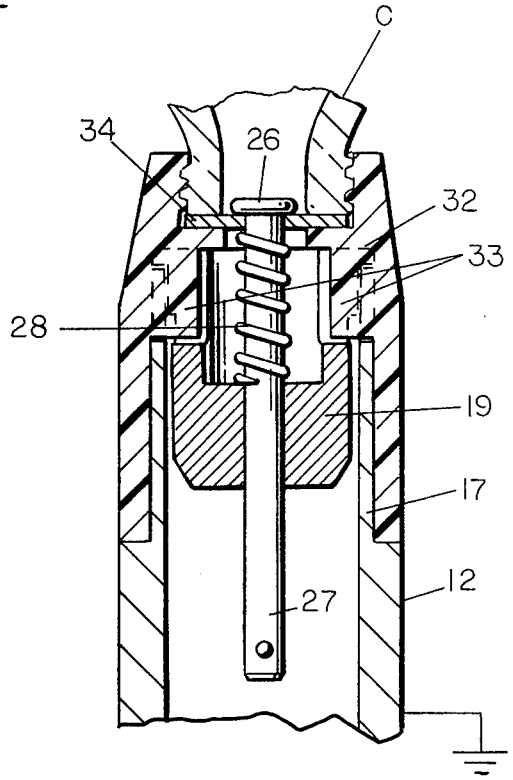
FIG. 4 is a second embodiment of a spindle of the invention showing a modified system for grounding the container.

Turning now to FIG. 4, there is shown a chuck 32 of non-conductive material which is supported on the upper cylinder 17 of the portion 12 of the spindle 11. The identical ground plug 19, as shown in FIG. 3, may be used in this embodiment, it being understood that the ground plug 19 is conductive and in actual practice is formed of brass. The ground plug 19 and the cylinder 17 are maintained in non-rotating relationship by ears 33 within the chuck 32. The identical ground pin 27, as used in the FIG. 3 embodiment, is used in this embodiment; however, since the container neck is of a larger diameter than the head 26 of the ground pin 27, a conductive washer 34 will be placed between the spring 28 and the head 26 of the pin 27. In this manner a conductive path will be completed between the surface of the neck of the container C and the ground plug 19. Again, the container will be threaded into the chuck 32.

Figure 5:
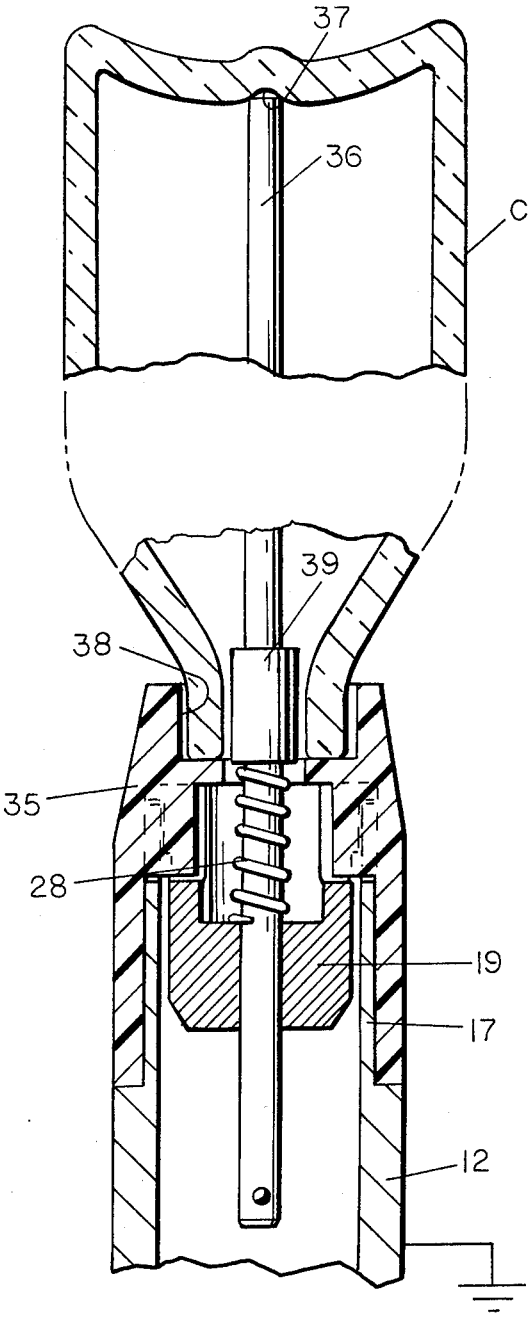
FIG. 5 is a view of a third embodiment of a spindle of the invention in which a conductive rod extends substantially the full height of the container.
Figure 6:
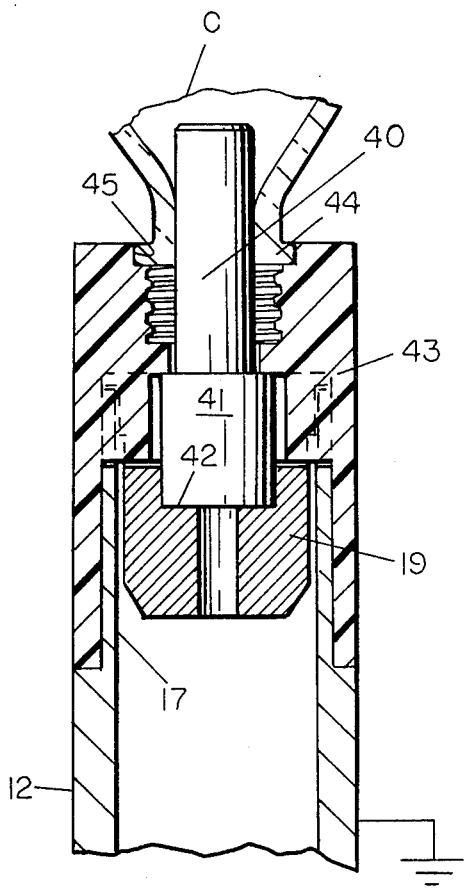
FIG. 6 shows a fourth embodiment of a spindle of the invention with a modified chuck and grounding pin.

FIGS. 5 and 6 show additional embodiments and illustrate the manner in which slightly modified chucks may be used when coating containers which do not have threaded necks. For example, in FIG. 5, a chuck 35 is mounted on the upper end of a spindle and carries a ground plug 19. In this embodiment, however, the ground pin is an elongated pin having a vertical extension 36 that extends throughout the height of the interior of the container C and has its upper end seated within a depression 37 formed in the inside bottom of the container C. In this manner the container C is steadied during its precessing movement through the coating zone where it is rotated about its axis to provide a uniform coating over the entire external surface of the container. Grounding of the container surface is accomplished and the pin will also serve to attract the charged particles to the container surface.

As can readily be seen when viewing FIG. 5, the upper end of the chuck 35 is provided with an annular recess 38 of a size to receive the neck portion of the container C. Furthermore, the ground pin used in this embodiment has an enlarged barrel portion 39 which is dimensioned with respect to the length of the extension 36 so as to be an aid to centering and stabilizing the neck of the container relative to the chuck and the ground pin. Again, a spring 28 surrounding the lower portion of the ground pin provides a conductive path from the portion 39 to the ground plug 19.

With particular reference to FIG. 6, a fourth embodiment of a chuck suitable for supporting containers being processed through a coating zone is shown. Essentially, all the elements are present in this embodiment as in the previous embodiments, with the exception that the ground pin in this embodiment takes the form of a pin 40 having a relatively large base portion 41. This base portion 41 is of a size to fit within a recess 42 in the ground plug 19. The upper portion of the pin 40 is of sufficient length to extend above the upper surface of a chuck 43. In the particular embodiment shown, the container is formed with a radial lip 44 surrounding the neck portion thereof. The lip 44 fits within a recess 45 in the upper surface of the chuck 43. The upper portion of the ground pin is formed with an outside diameter closely paralleling the inside diameter of the container which it is intended to support. With the configuration shown in FIG. 6, the ground pin 40 provides sufficient stabilization to the container C and will provide the requisite grounding, such that it will successfully be conveyed through a coating process, yet the container can be removed from the ground pin by an operator.

While no specific materials have been mentioned with respect to the ground pin, it may be made of aluminum which is sufficiently conductive to serve to provide an electrical path extending from the heated container to the suitably grounded spindle.

We claim:

1. Apparatus for electrostatically coating hollow glass articles having an opening leading into the interior, wherein the articles are supported adjacent the opening and electrostatically charged particles are directed toward the articles from at least one side thereof, the improvement in the article support comprising:

a series of electrically, grounded vertical spindles;

means to rotate said spindles about their vertical axes and to simultaneously transport said spindles in series through the field of charged particles;

a spindle ground plug telescopically received in the upper end of each spindle;

a non-conductive chuck mounted to the upper end of the spindle and extending thereabove, said chuck further being formed with a lower skirt that surrounds that portion of the spindle that contains the ground plug; and a ground pin in contact with said plug and having a portion extending upward through a central opening in said chuck.

2. The apparatus of claim 1, wherein said ground pin extends downward through an opening in said plug with the opposite end extending into the interior of the article through the opening in said article.

3. The apparatus of claim 2, wherein said article is a glass container and said pin extends through the opening in said container and has its upper end seated within a recess in the central bottom of said container.

4. The apparatus of claim 3, wherein said pin is provided with an enlarged zone intermediate its length, said zone corresponding to the neck area of a container positioned over said pin, and spring means between said enlarged zone and the top of said plug.

5. The apparatus of claim 2, wherein said article is a glass container and said pin has an outer diameter approximate the inner diameter of the container, whereby the container neck fits over the pin, and an annular recess in the upper face of said chuck within which the container neck is positioned whereby the container is supported by the chuck and maintained in an upright position by the pin extending therein.

6. The apparatus of claim 5, wherein said container is at a temperature such that it is relatively conductive.

7. The apparatus of claim 1, wherein said chuck has an internally threaded upper opening for receiving the threaded neck portion of glass containers.

8. The apparatus of claim 7, wherein said ground pin extends downward through an opening in said ground plug and the upper end of said pin is formed with an enlarged head.

9. The apparatus of claim 8, wherein said enlarged head is of a greater diameter than the internal neck of the container, and spring means urging the head of said pin into engagement with said container neck held in said chuck.

10. The apparatus of claim 8, wherein said enlarged head of said ground pin is smaller than the interior diameter of the container neck and further including a conductive washer positioned between said container neck and said chuck, said ground pin enlarged head contacting said conductive washer.

* * * * *